US007105995B2

(12) United States Patent
Park et al.

(10) Patent No.: US 7,105,995 B2
(45) **Date of Patent: *Sep. 12, 2006**

(54) COLOR CATHODE RAY TUBE

(75) Inventors: Sang Yoon Park, Gumi-si (KR); Jong Eon Choi, Gumi-si (KR); Pyeong Soo Jeong, Daegukwayuk-si (KR)

(73) Assignee: LG.Philips Display Co., Ltd., Gumi-si (KR)

( * ) Notice: Subject to any disclaimer, the term of this patent is extended or adjusted under 35 U.S.C. 154(b) by 169 days.

This patent is subject to a terminal disclaimer.

(21) Appl. No.: 10/834,011

(22) Filed: Apr. 29, 2004

(65) Prior Publication Data

US 2005/0057140 A1 Mar. 17, 2005

(30) Foreign Application Priority Data

Sep. 17, 2003 (KR) ..... 10-2003-0064595
Sep. 17, 2003 (KR) ..... 10-2003-0064596
Nov. 6, 2003 (KR) ..... 10-2003-0078233

(51) Int. Cl.
*H01J 29/80* (2006.01)

(52) U.S. Cl. ..... 313/407; 313/402

(58) Field of Classification Search ..... 313/402–408
See application file for complete search history.

(56) References Cited

U.S. PATENT DOCUMENTS 3,792,300 A * 2/1974 Benda et al. ..... 313/439
6,051,918 A * 4/2000 Hayashi et al. ..... 313/407
6,501,214 B1 * 12/2002 Sakamoto et al. ..... 313/407

FOREIGN PATENT DOCUMENTS

JP 49-112566 10/1974
JP 62-177831 A 8/1987
JP 63-271849 A 11/1988
JP 1-169847 A 7/1989
JP 6-267446 A 9/1994

* cited by examiner

*Primary Examiner*—Vip Patel
(74) *Attorney, Agent, or Firm*—Birch, Stewart, Kolasch & Birch, LLP

(57) ABSTRACT

A color cathode ray tube in which beam landing errors caused by non-uniform thermal expansion of a shadow mask are corrected is provided such that color purity is improved. The color cathode ray tube in accordance with the present invention comprises a panel having a phosphor screen formed on an inner surface thereof, a shadow mask having a faceplate portion and a peripheral skirt portion bent back from the faceplate portion and a frame joined to the skirt portion, wherein a height of the skirt portion is less than or equal to 12 mm for substantially the entire skirt portion, and a plurality of holes are perforated at the skirt portion.

26 Claims, 11 Drawing Sheets

Replacement Sheet
Fig. 3b
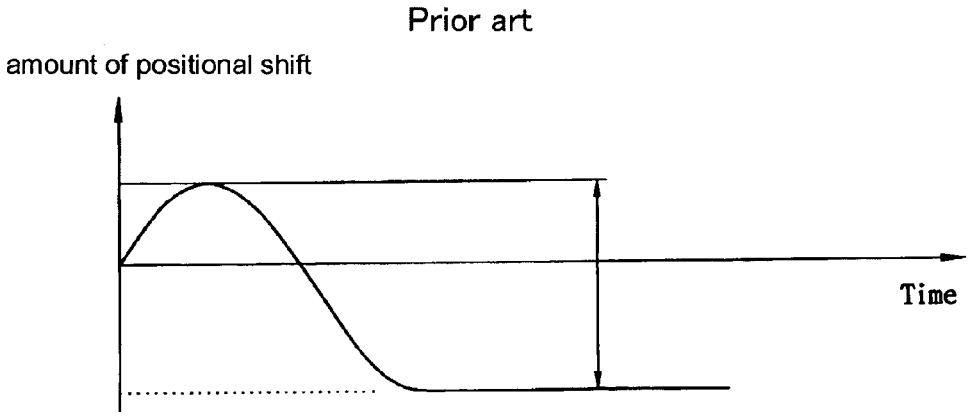

COLOR CATHODE RAY TUBE

This Nonprovisional application claims priority under 35 U.S.C. § 119(a) on patent application Ser. No. 10-2003-64595 filed in Korea on Sep. 17, 2003, application Ser. No. 10-2003-64596 filed in Korea on Sep. 17, 2003 and application Ser. No. 10-2003-78233 filed in Korea on Nov. 6, 2003, the entire contents of which are hereby incorporated by reference.

BACKGROUND OF THE INVENTION

1. Field of the Invention

The present invention relates to a color cathode ray tube and more specifically to a color cathode ray tube in which beam landing errors caused by non-uniform thermal expansion of a shadow mask are corrected such that color purity is improved.

2. Description of the Background Art

FIG. 1 shows a schematic diagram illustrating the structure of a general color cathode ray tube of the background art. As shown in FIG. 1, the color cathode ray tube generally includes a glass envelope having a shape of bulb and is comprised of a faceplate panel 10, a tubular neck 120, and a funnel 20 connecting the panel 10 and the neck 120.

The panel 10 comprises a faceplate portion and a peripheral sidewall portion sealed to the funnel 20. A phosphor screen 30 is formed on the inner surface of the faceplate portion. The phosphor screen 30 is coated by phosphor materials of R, G, and B. A multi-apertured color selection electrode, i.e., shadow mask 40 is mounted to the screen with a predetermined space. The shadow mask 40 is supported by a peripheral frame 70. An electron gun 50 is mounted within the neck to generate and direct electron beams 60 along paths through the mask to the screen.

The shadow mask 40 and the frame 70 constitute a mask-frame assembly. The mask-frame assembly is joined to the panel 10 by means of springs 80.

The cathode ray tube further comprises an inner shield 90 for shielding the tube from external geomagnetism, a reinforcing band 100 attached to the sidewall portion of the panel 10 to prevent the cathode ray tube from being exploded by external shock, and external deflection yoke 110 located in the vicinity of the funnel-to-neck junction.

The electron beams generated by the electron gun are deflected in either vertical or horizontal directions by the deflection yoke 110. The electron beams are selected by the shadow mask depending on the colors and impinge on the phosphor screen such that the phosphor screen emits light in different colors. Typically, about 80% of the electrons from the electron gun 50 fail to pass through the apertures of the shadow mask 40. The 80% of electrons impinge upon the shadow mask 40, producing heat and raising the temperature of the mask 40.

FIG. 2 shows a perspective view of a lower right quarter of a shadow mask illustrating thermal distribution of the surface of the mask due to the impingement of electrons. As shown in FIG. 2, the temperature of the mask is different for different portions of the mask. In FIG. 2, a center portion of the mask has a higher temperature than a corner portion. The reason why the corner portion has a lower temperature is that the heat at the corner portion is dissipated through the frame attached to the mask. Since the frame is attached to the mask at the skirt portion near the corner, heat at the corner is easily transferred to the outside via the frame. Because the mask is thermally expanded, a position of the apertures at the shadow mask is shifted from the desired position accordingly. Therefore, electron beams passing through the apertures land at the screen incorrectly. In this way the color purity at the screen is degraded. This phenomenon of purity degradation resulting from the undesired positional shift of the apertures of the mask is called the "doming effect."

FIG. 3*a* shows a cross-sectional view of the shadow mask for illustrating purity degradation resulting from the positional shift of the apertures of the shadow mask 40. FIG. 3*b* is a graph showing the extent of variation in the positional shift of electrons landing incorrectly at the screen with respect to time when the cathode ray tube is placed in operation.

As shown in FIG. 3*a,* an electron beam landing at the screen is shifted due to the positional shift of the apertures of the shadow mask. As shown in FIG. 3*b,* the extent of the shift of the electron beam landing at the screen increases just after the cathode ray tube is operated, since the temperature of the shadow mask begins to increase. However, as the heat at the shadow mask is transferred to the frame, the frame is heated and expanded. Accordingly, the positional shift of the electron landing is decreased. As the heat dissipation through the frame continues, the landing position of the electron beam is displaced in the opposite direction with respect to the initial shift, which occurs just after the initial operation of the shadow mask.

The variation in the shift of the electron beam landing causes degradation of color purity. Further, since the landing position varies in accordance with the time after the shadow mask is operated, restoration of the aperture position with respect to the screen is difficult.

FIG. 4 is a perspective view of the conventional shadow mask. The conventional shadow mask comprises a central apertured portion 41 through which electron beams pass, a non-apertured border portion 42 surrounding the apertured portion 41, and a peripheral skirt portion 43 bent back from the border portion 42 and extending backward from the apertured portion 41. As shown in FIG. 4, the border portion 42 and the skirt portion 43 have more area than is necessary in view of the function they perform. The large area of the border portion 42 and the skirt portion 43 increases the non-uniformity of thermal expansion across the shadow mask. Therefore, the conventional shadow mask suffers from color purity degradation caused by the doming effect.

Moreover, the welding point between the shadow mask and the frame intensifies the non-uniformity of the thermal expansion. Typically, the shadow mask is fixed to the frame by welding through a plurality of welding points 43*a.* When the shadow mask expands thermally due to the beam radiation, the welding points become binding points against the expansion of the shadow mask. Therefore, the non-uniformity of expansion of the shadow mask is increased, thereby increasing a landing error of the electron beams.

In order to prevent or lessen the doming effect caused by a landing error of the electron beams, many different approaches have been used.

First, structural improvements of the shadow mask have been suggested in order to prevent the landing error problem. According to Japanese Laid-Open Patent Publication No. S62-177831, a temperature control device is provided within the cathode ray tube in order to suppress the temperature elevation of the mask. Also, according to Japanese Laid-Open Patent Publication No. H6-267446, a reinforcement member for maintaining the shape of the shadow mask is provided between the shadow mask and the frame. However, the landing error problem was not solved by those structural approaches.

Also, improvement in the material used for the shadow mask was suggested. Invar material having a low thermal expansion rate was used for the shadow mask instead of aluminum killed (AK) material. However, the result of using the invar material was not satisfactory in view of the price of the material.

Finally, there have been many approaches to solve landing errors caused by spring back phenomenon. Spring back phenomenon occurs when the shadow mask is manufactured by a forming process. When a forming process is used in making a shadow mask, a shadow mask is formed by pressing to have a shape comprising a central portion and a skirt portion bent back from the central portion 41 and extending backward. Then, the shadow mask is fixed to a frame. After the mask-frame assembly is made, the skirt portion of the shadow mask tends to move outward from the center by a resilient force. This is called spring back phenomenon. This spring back phenomenon is one of the causes of the landing error problem.

As a solution for solving the landing error problem due to the spring back phenomenon, an idea of making the border portion of the shadow mask to be partially thinner than the central portion was suggested in Japanese Laid-Open Patent Publication No. S49-112566. Additionally, according to Japanese Laid-Open Patent Publication No. S63-271849, protrusions are provided, which are protruded from a skirt portion of a shadow mask backward from a central portion. According to Japanese Laid-Open Patent Publication No. H1-169847, many openings are perforated in the skirt portion for absorbing compression stress. However, those techniques are directed to solving the landing error problem caused by the spring back phenomenon. Therefore, those techniques are not sufficient to solve the problem due to the non-uniform thermal expansion of the shadow mask.

SUMMARY OF THE INVENTION

Accordingly, an object of the present invention is to solve at least the problems and disadvantages of the background art.

An object of the present invention is to provide a color cathode ray tube in which a landing error problem causing degradation of color purity is prevented.

Another object of the present invention is to provide a color cathode ray tube in which non-uniform thermal expansion of the shadow mask is avoided such that color purity is improved.

A further object of the present invention is to provide a color cathode ray tube in which the influence of the welding point between the shadow mask and frame upon thermal expansion of the shadow mask is minimized such that color purity is improved.

According to an aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein height of the skirt portion is less than or equal to 12 mm for substantially entire skirt portion, and a plurality of holes are perforated at said skirt portion.

According to another aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein a plurality of holes are perforated at the skirt portion, said skirt portion includes a protrusion having a welding point at which to weld to said frame, and said plurality of holes are located at part of said skirt portion which is not opposite to said frame.

According to another aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein said skirt portion includes a protrusion having a welding point at which to weld said frame, and a plurality of holes are provided at part of said skirt portion which is opposite to said frame.

According to a further aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein said skirt portion includes a protrusion having a welding point at which to weld said frame, and a ratio of a height Ho of the part of said skirt portion which is opposite to said frame and a height H of said skirt portion, i.e., Ho/H, is less than or equal to 0.8.

BRIEF DESCRIPTION OF THE DRAWINGS

The invention will be described in detail with reference to the following drawings in which like numerals refer to like elements.

FIG. 3*b* shows a graph depicting variation in an amount of positional shift of electrons landing incorrectly at the screen with respect to time after the cathode ray tube is placed into operation.

DETAILED DESCRIPTION OF PREFERRED EMBODIMENTS

Figure 1:
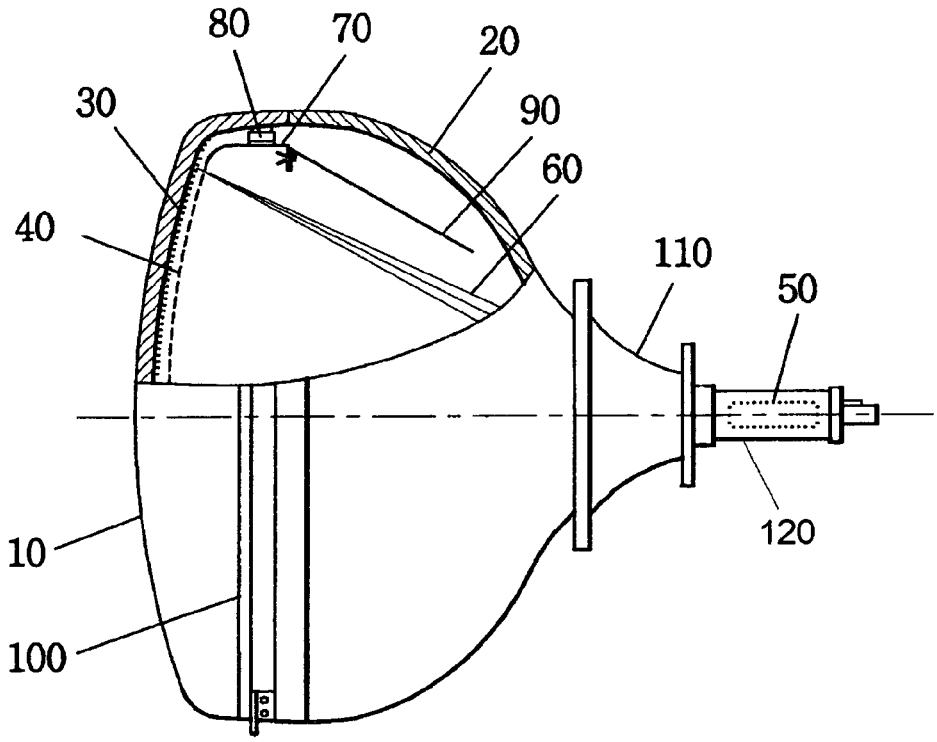
Fig. 1 Prior art
FIG. 1 shows a schematic diagram illustrating the structure of a general color cathode ray tube of the background art.
Figure 2:
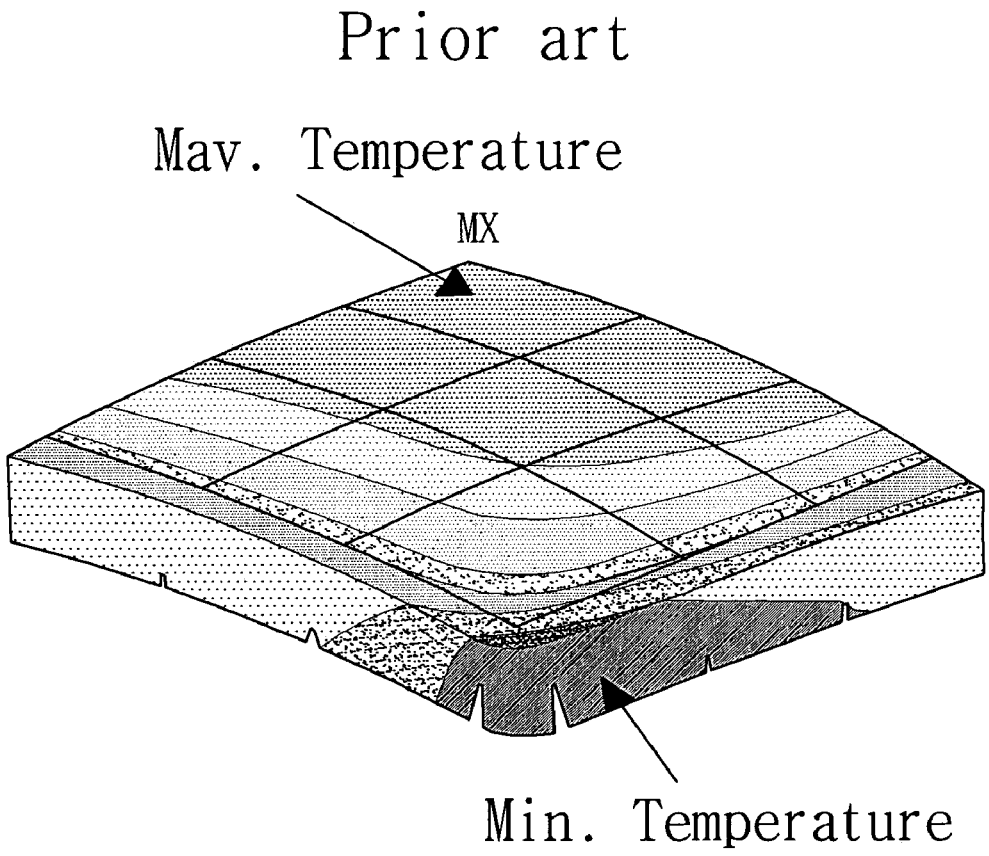
FIG. 2 shows a perspective view of a lower right quarter of a shadow mask illustrating thermal distribution of the surface of the mask due to the impingement of electrons.
Figure 3A:
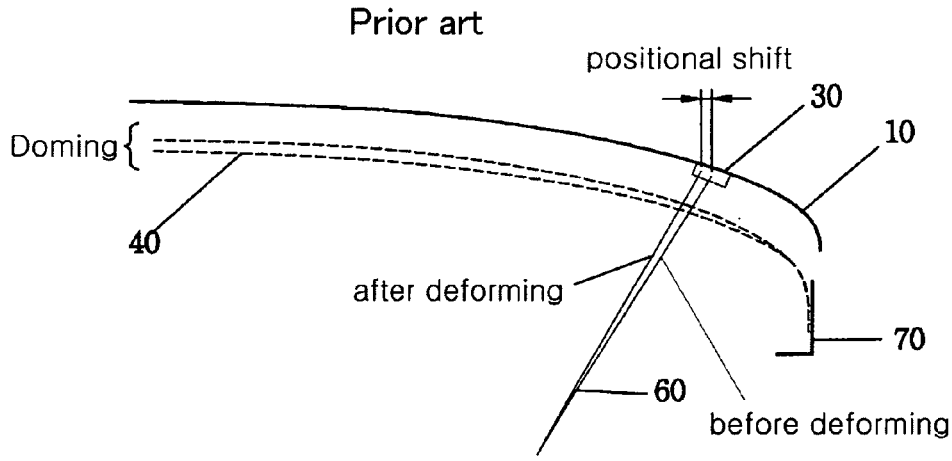
FIG. 3*a* shows cross-sectional view of the shadow mask for illustrating purity degradation resulting from the positional shift of the apertures of the shadow mask.
Figure 4:
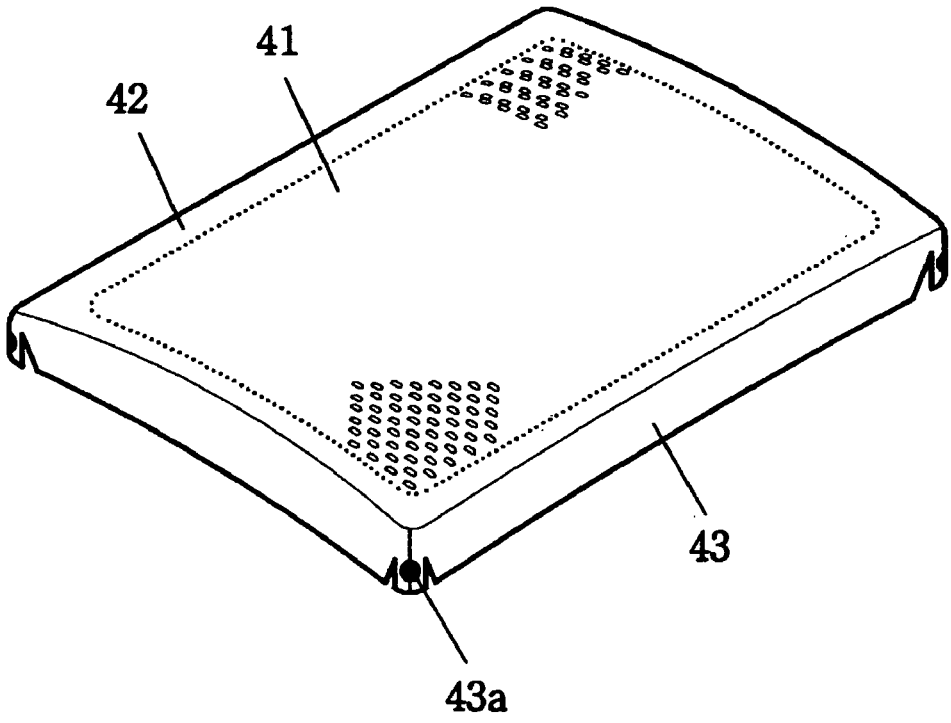
Fig. 4 Prior art
FIG. 4 shows a perspective view of a shadow mask of the background art.
Figure 4:
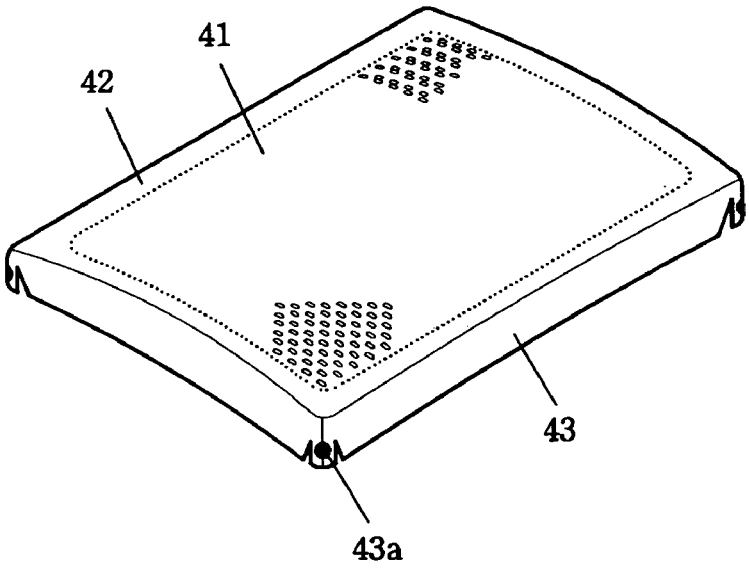

Preferred embodiments of the present invention will be described in a more detailed manner with reference to the drawings. The embodiments may be implemented in the device shown in FIG. 1.

<First Embodiment>

According to an aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein height of the skirt portion is less than or equal to 12 mm for substantially entire skirt portion, and a plurality of holes are perforated at said skirt portion.

Figure 5A:
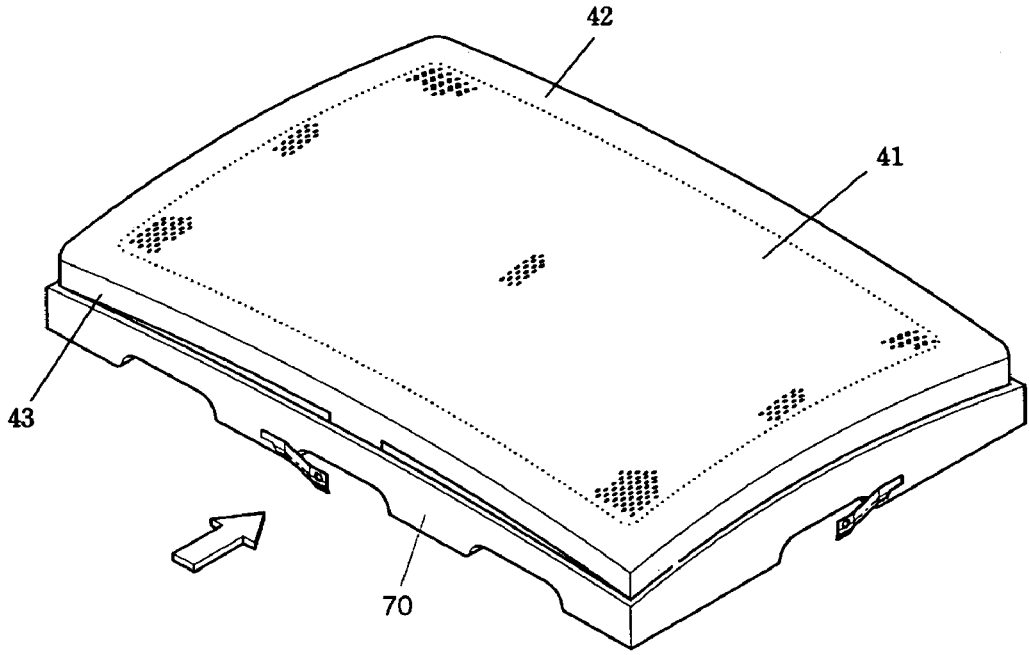
FIG. 5*a* shows a perspective view of a shadow mask in accordance with an embodiment of the present invention.

FIG. 5*a* shows a perspective view of a shadow mask in accordance with a preferred embodiment of the present invention.

As shown in FIG. 5*a,* the shadow mask in accordance with this embodiment comprises a faceplate portion 41 and a peripheral skirt portion 43 bent back from the faceplate portion 41 and extending backward from faceplate portion 41. The faceplate portion 41 includes an apertured portion wherein minute apertures through which electron beams pass are defined, and a non-apertured border portion 42 surrounding the apertured portion.

Figure 6A:
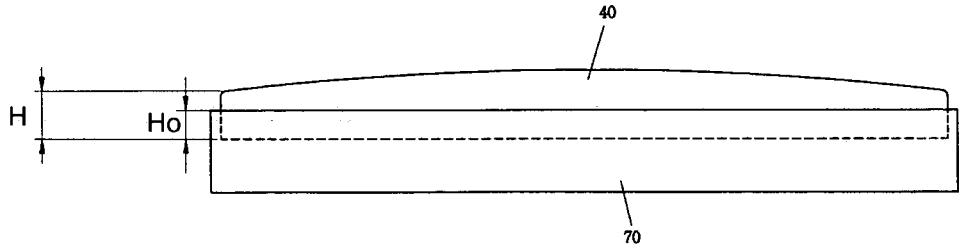
FIGS. 6*a* and 6*b* show a side view of a mask-frame assembly to illustrate an example of the relatively long and short skirt portions respectively.
Figure 6B:
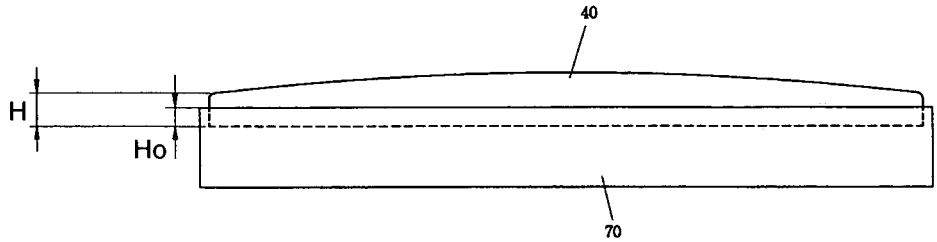

According to this embodiment, by making the part of the skirt portion 43, which is opposite to the frame 70 as small as possible, heat transfer between the skirt portion 43 and the frame 70 is minimized. Accordingly, non-uniformity of thermal expansion between the central and peripheral portions in the shadow mask is decreased such that a landing error of the electron beam caused by the non-uniformity of expansion is decreased. The inventor conducted experiments related to the height of the skirt portion in order to discover a size of the skirt portion by which the area of the part of the skirt portion opposite to the frame can be made as small as possible. The height of the overall skirt portion was varied. FIGS. 6*a* and 6*b* show a side view of the mask-frame assembly to illustrate an example of the skirt portions having relatively long and short heights respectively. As shown in FIGS. 6*a* and 6*b,* as the height H of the skirt portion decreases, the height Ho of the part of the skirt portion which is opposite to the frame decreases accordingly.

Figure 7:
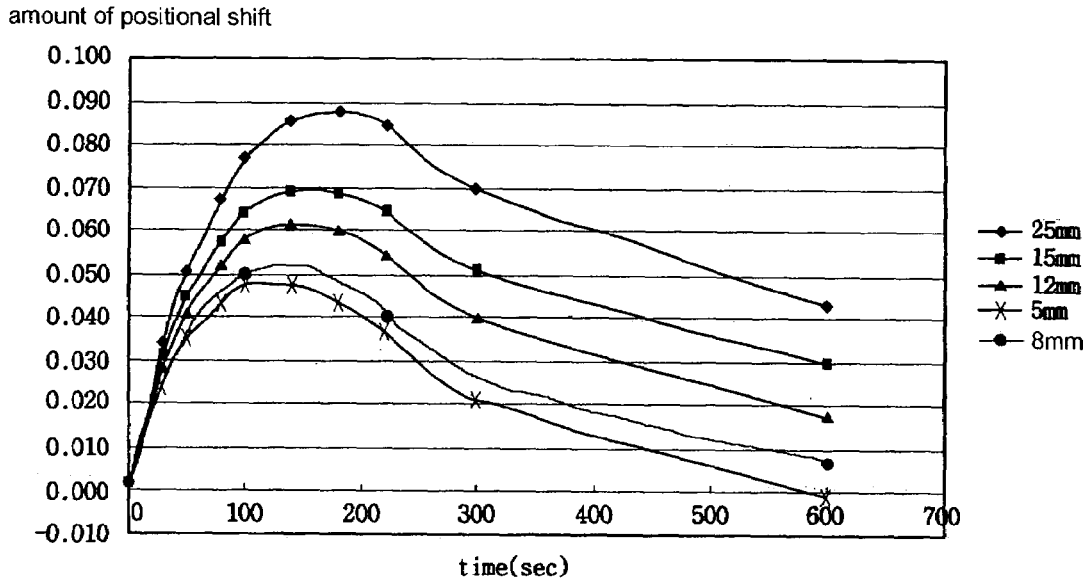
FIG. 7 shows a graph illustrating the result of Table 1.

Table 1 shows the result of an experiment wherein a landing error was measured for various shadow masks having skirt portions of various heights. FIG. 7 shows a graph illustrating the results in Table 1.

TABLE 1

| Item | | Height of the skirt portion(mm) | | | | |
|---|---|---|---|---|---|---|
| | | Background Art | | The Present Invention | | |
| Time (sec) | | 25 | 15 | 12 | 8 | 5 |
| 1 | Amount of Landing Error | 0.002 | 0.002 | 0.002 | 0.002 | 0.002 |
| 30 | | 0.034 | 0.031 | 0.029 | 0.026 | 0.025 |
| 50 | | 0.050 | 0.045 | 0.041 | 0.037 | 0.035 |
| 80 | | 0.067 | 0.058 | 0.053 | 0.046 | 0.044 |
| 100 | | 0.077 | 0.064 | 0.058 | 0.050 | 0.047 |

TABLE 1-continued

| Item | Height of the skirt portion(mm) | | | | |
|---|---|---|---|---|---|
| | Background Art | | The Present Invention | | |
| Time (sec) | 25 | 15 | 12 | 8 | 5 |
| 140 | 0.085 | 0.069 | 0.062 | 0.051 | 0.048 |
| 180 | 0.087 | 0.069 | 0.060 | 0.047 | 0.044 |
| 220 | 0.084 | 0.065 | 0.055 | 0.040 | 0.037 |
| 300 | 0.070 | 0.051 | 0.040 | 0.032 | 0.021 |
| 600 | 0.043 | 0.029 | 0.017 | 0.008 | −0.001 |

As shown in Table 1 and FIG. 7, as the height H of the skirt portion decreases, the height Ho of the part of the skirt portion which is opposite to the frame decreases accordingly. Consequently, heat transfer from the shadow mask to the frame decreases, and, therefore a landing error of the electron beam decreases. According to the result of the experiment shown in Table 1 and FIG. 7, a landing error of the electron beam was remarkably decreased when the height of the skirt portion was less than or equal to 12 mm. When the height of the skirt portion is less than or equal to 12 mm, a height of the part of the skirt portion which is opposite to the frame becomes less than or equal to 10 mm. Consequently, when a height of the part of the skirt portion which is opposite to the frame is less than or equal to 10 mm, a landing error of the electron beam is remarkably reduced.

Figure 6C:
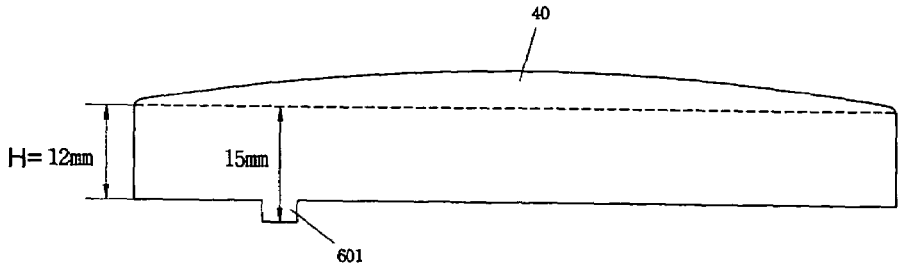
FIG. 6*c* shows an example of a skirt portion having a protrusion.

In other words, if the height is less than or equal to 12 mm for the substantially entire skirt portion, a landing error problem can be remarkably reduced. FIG. 6*c* shows a side view of a modified version of the first embodiment presented above. As shown in FIG. 6*c,* the skirt portion can have a protrusion 601 by which the height of the skirt portion including the protrusion 601 exceeds 12 mm. However, other areas of the skirt portion are still equal to, or less than 12 mm. Although a protrusion is formed at the skirt portion, the effect of reducing a landing error can still be achieved. This is because the area of the protrusion is negligible with respect to the overall area of the skirt portion. Therefore, the modified embodiment of FIG. 6*c* is within the scope of the present invention.

If a height of the skirt portion is within the range of 3 mm to 10 mm, the effect is maximized. Then, a landing error is reduced effectively by decreasing heat transfer from the shadow mask to the frame.

Further, if the ratio of a height Ho of the part of the skirt portion which is opposite to the frame and a height H of the skirt portion, i.e., Ho/H, is less than or equal to 0.8, a similar effect is achieved. Preferably, if Ho/H is less than or equal to 0.5, the effect is maximized.

If the height H of at least 65% of the overall skirt portion at a long side of the faceplate portion of the shadow mask is less than or equal to 12 mm, a landing error can be avoided to the same extent as the above-mentioned embodiment. Also, if the height H of at least 60% of the overall skirt portion at a short side of the faceplate portion of the shadow mask is less than or equal to 12 mm, a landing error can also be avoided to the same extent as the above-mentioned embodiment. These modifications to the embodiment can also achieve the effect that landing error is reduced remarkably by decreasing heat transfer between the mask and the frame.

Figure 5B:
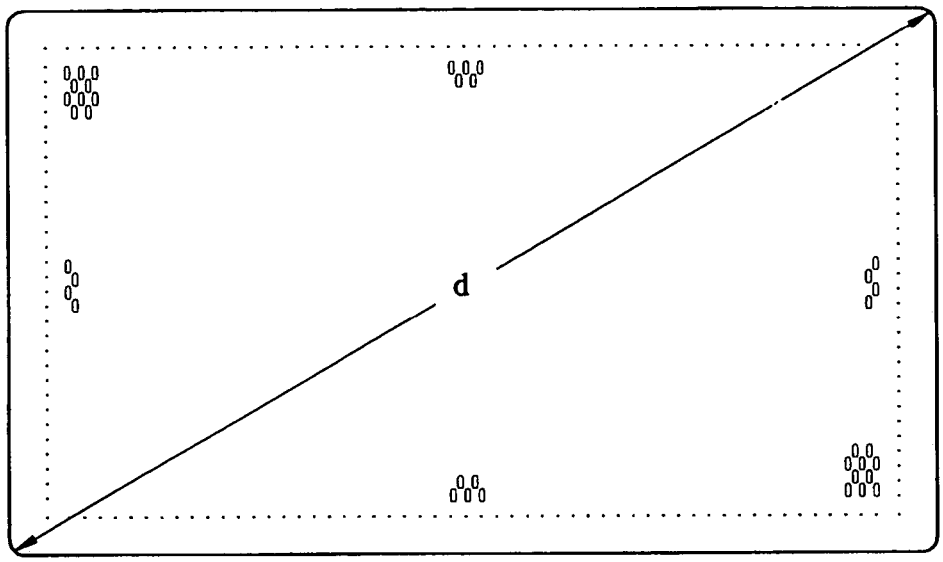
FIG. 5*b* shows a plane view of the shadow mask in accordance with an embodiment of the present invention.

FIG. 5*b* shows a plane view of a shadow mask in accordance with the present invention. Referring to FIG. 5*b,* the first embodiment (presented above) can be modified such that the shadow mask is improved by changing the area of the skirt portion with respect to the faceplate portion of the shadow mask. Here, the faceplate portion refers to a front face side of the shadow mask which includes the apertured portion and the border portion of the shadow mask. When the ratio of the areas of the faceplate portion to the skirt portion of the shadow mask is not less than $d^2/(d+24)^2$ and no greater than 1, wherein d is the diagonal length of the faceplate portion of the shadow mask, it was found that the heat transfer from the shadow mask to the frame is remarkably reduced. A landing error of the electron beams is reduced accordingly.

According to a modified version of the first embodiment of the present invention, in addition to reducing a height of the skirt portion or limiting the height to an appropriate range, holes are perforated at the skirt portion. With the holes, heat transfer from the shadow mask to the frame can be reduced even further. Accordingly, a landing error of the electron beams can also be remarkably reduced. According to another version of the first embodiment, the holes may have various shapes, e.g., circular, elliptical, or a rectangular shape. According to a further modified version of the first embodiment, the holes may be opened to the rearward direction from the front face side of the shadow mask. Further, the holes may be perforated at the part of the skirt portion which is opposite to the frame.

Figure 8:
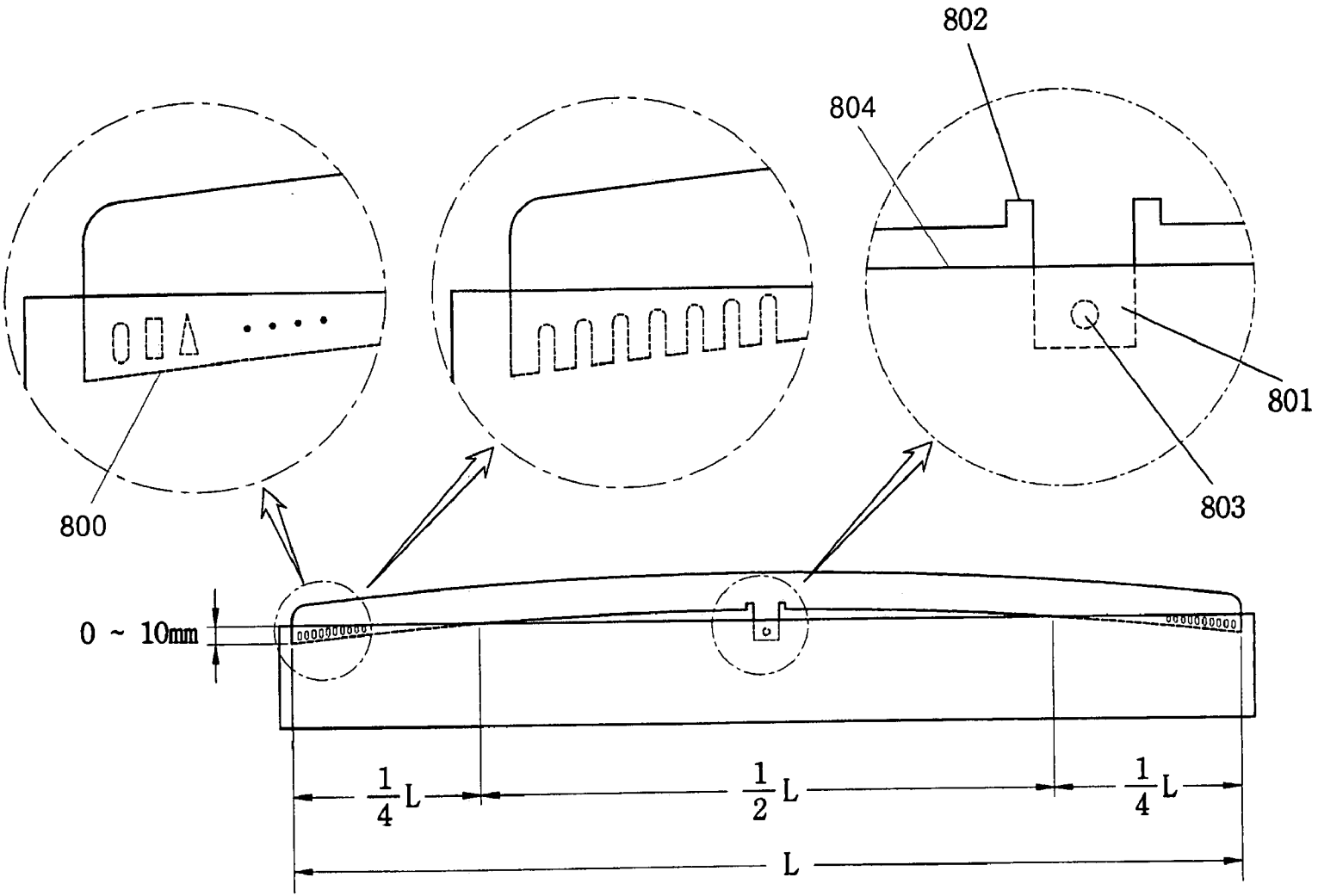
FIG. 8 shows a side view of the shadow mask in accordance with a modified version of an embodiment of the present invention.

According to another modified version of the first embodiment, an edge line 800 of the skirt portion curves toward the front face side of the shadow mask. Therefore, the edge line bends toward the front face of the shadow mask as it is near the central portion of the edge line. FIG. 8 shows a side view of the shadow mask in accordance with this modified version of. As shown in FIG. 8, a maximum of the height of the part of the skirt portion which is opposite to the frame is no greater than 10 mm. Additionally, the edge line of the skirt portion curves toward the front face of the shadow mask. Therefore, the area of the part which is opposite to the frame can be reduced further in comparison to an embodiment wherein only the height of the skirt portion is reduced.

Since the edge line curves toward the front face side, the part of the skirt portion which is opposite to the frame has a maximum height at the corner of the faceplate. The portion opposite to the frame becomes shorter as it nears the center of the skirt portion. At a central part of the skirt portion, the part which is opposite to the frame does not exist. Preferably, a length of the edge line of the skirt portion, which is a greater distance away from the front face side than the edge line 804 of the frame, is no greater than ½ of the overall length of the edge line.

Since the edge line 800 curves toward the front face side, the central portion of the edge line is closer to the front face side than the edge line 804 of the frame. In this case, the skirt portion may have a protrusion 801 having a welding point 803 at which to weld the frame. FIG. 8 shows a side view of the shadow mask where the skirt portion has a protrusion. This protrusion may be provided instead of, or in addition to welding points at four corners of the shadow mask. With the protrusion 801, it is possible to further reduce the height of the portion of the skirt portion which is opposite to the frame. Moreover, it is possible to prevent the welding points at four corners of the shadow mask from becoming a source of binding when the mask expands. Therefore, a landing error problem is reduced even further.

According to still another modified version of the first embodiment, a notch 802 is cut at an edge of the protrusion 801. By providing the notch 802, it is possible to further reduce the extent that the welding point at the protrusion 801 acts as a source of binding against thermal expansion of the shadow mask. Accordingly, an amount of landing error is further diminished.

Additionally, holes may be perforated at the protrusion 801 such that an area of the part of the skirt portion which is opposite to the frame is further reduced. Accordingly, an amount of the landing error is further diminished.

For each version of the first embodiment described hereinabove, even when the shadow mask is made of AK material a landing error is still remarkably reduced in comparison with the prior art.

Further, an electron beam reflective material may be coated on the back plate surface of the shadow mask on which the electrons impinge. With the reflective material, heat generation due to impingement of electron beams is reduced. Therefore, a temperature elevation of the shadow mask is reduced and, accordingly, a landing error is further reduced.

Further, each of the embodiments described hereinabove may be applied to a flat type color cathode ray tube in which an outer surface of the panel is substantially flat. Therefore, the present invention is still effective for a flat type color cathode ray tube.

<Second Embodiment>

According to another aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein a plurality of holes are perforated at the skirt portion, said skirt portion includes a protrusion having a welding point at which to weld to said frame, and said plurality of holes are located at part of said skirt portion which is not opposite to said frame.

Figure 9:
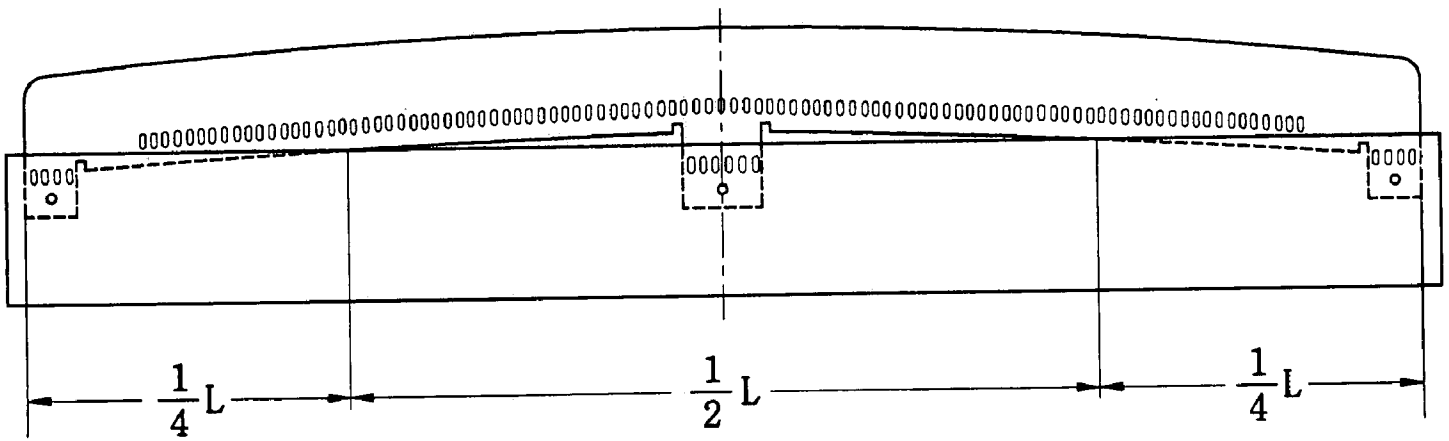
FIG. 9 shows a side view of a shadow mask in accordance with another embodiment of the present invention viewing from the arrow direction of FIG. 5.

FIG. 9 shows a side view of a shadow mask in accordance with a second embodiment of the present invention viewing from the arrow direction of FIG. 5.

According to this embodiment, holes are perforated and protrusions are provided at the skirt portion. Additionally, the holes are located at the part of a skirt portion which is not opposite to the frame. Since the skirt portion acts as a media for transfer of heat from the shadow mask to the frame, the skirt portion is located such that the part of the skirt portion which is opposite to the frame is made as small as possible. Then, holes are perforated in the skirt portion at a part which is not opposite to the frame at locations near to the edge line of the frame. Additionally, protrusions are provided at the skirt portion such that the holes are located over the edge line of the frame. Therefore, heat transfers between the shadow mask and the frame and, accordingly, a landing error due to non-uniform thermal expansion is remarkably reduced.

For this embodiment, the modifications made to as described above with respect to the first embodiment may also be applied. Such modifications includes: curving the edge line of the skirt portion; limiting an area of the part in the skirt portion which is not opposite to the frame; limiting a ratio of a height of the part that is opposite to the frame with respect to overall height of the skirt portion; providing a notch at edge of a protrusion; providing holes at the protrusion; and modifying a shape of the holes at the skirt portion. An understanding of such modifications may be obtained by reference the modifications made with respect to the first embodiment.

In the second embodiment, the modifications described with respect to the first embodiment may further include such modifications as the use of AK material for the shadow mask; using an electron beam coating material on the inner surface of the shadow mask; and making the outer surface of panel substantially flat.

<Third Embodiment>

According to another aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein said skirt portion includes a protrusion having a welding point at which to weld said frame, and a plurality of holes are provided at part of said skirt portion which is opposite to said frame.

Figure 10:
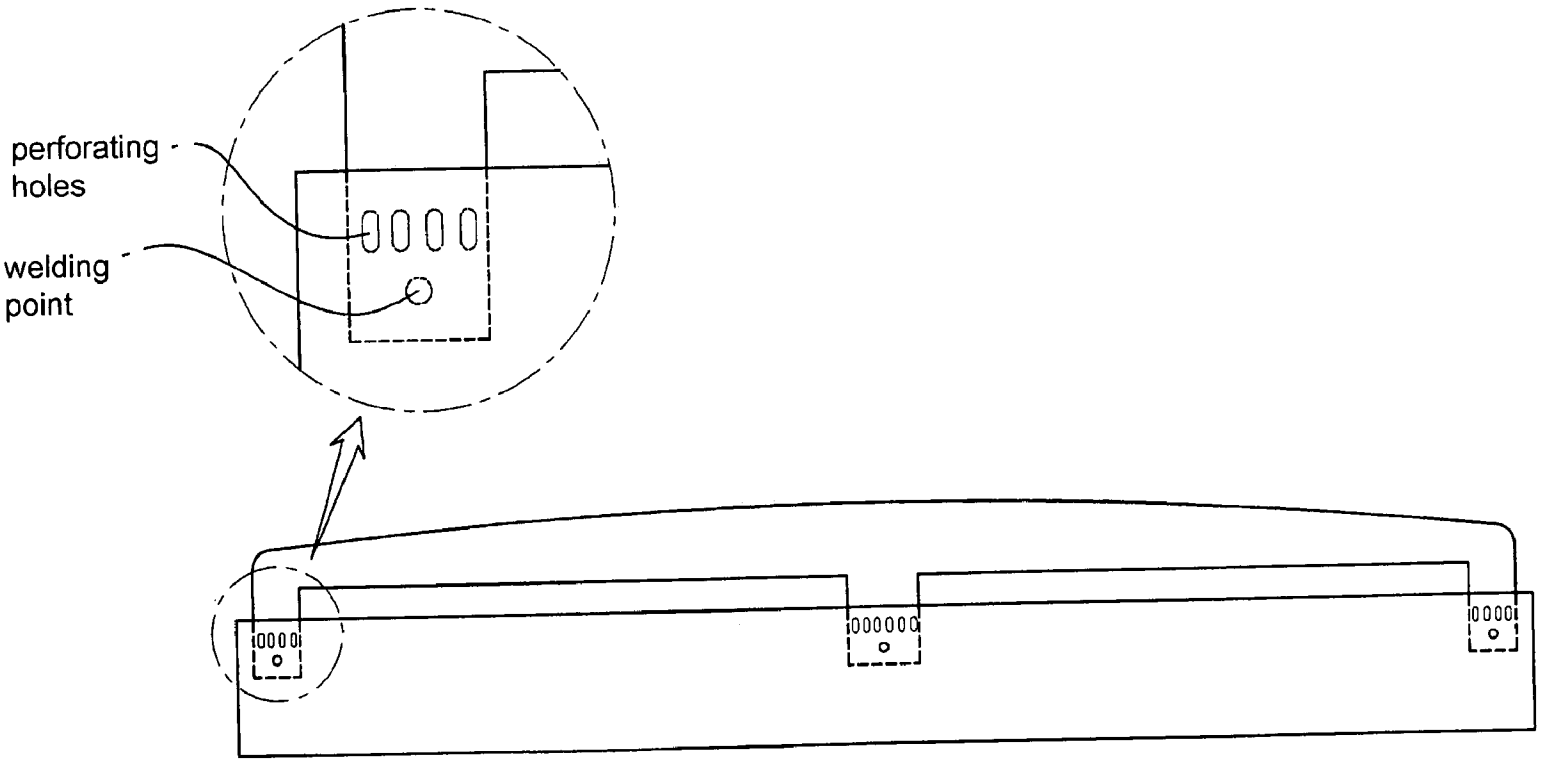
FIG. 10 shows a side view of a shadow mask in accordance with another embodiment of the present invention viewing from the arrow direction of FIG. 5.

FIG. 10 shows a side view of a shadow mask in accordance with a third embodiment of the present invention viewing from the arrow direction of FIG. 5.

According to this third embodiment, the skirt portion is excluded. The skirt portion acts as a media for heat transfer between the shadow mask and the frame. Instead of the skirt portion, a protrusion is provided, which protrudes from the faceplate portion of the shadow mask rearwardly. Since the skirt portion is removed, only the protrusions are opposite to the frame, which are small in area in comparison with the overall skirt portion. Therefore, it is possible to reduce heat dissipation into the shadow mask considerably by excluding the skirt portion. Further, the area of a portion the protrusion which is opposite to the frame may be reduced further by perforating holes at that portion. Accordingly, a landing error of the electron beams may be reduced further.

According to a modified version of the third embodiment, the width of the protrusions may range from 10 mm to 40 mm. If the width of the protrusions are in this range, a, landing error may be effectively reduced.

<Fourth Embodiment>

According to a further aspect of the present invention, a color cathode ray tube comprising a panel having a phosphor screen formed on an inner surface thereof, a shadow mask having a faceplate portion and a peripheral skirt portion bent back from the faceplate portion and a frame joined to the skirt portion of the shadow mask is provided, wherein said skirt portion includes a protrusion having a welding point at which to weld said frame, and a ratio of a height Ho of the part of said skirt portion which is opposite to said frame and a height H of said skirt portion, i.e., Ho/H, is less than or equal to 0.8.

Figure 11:
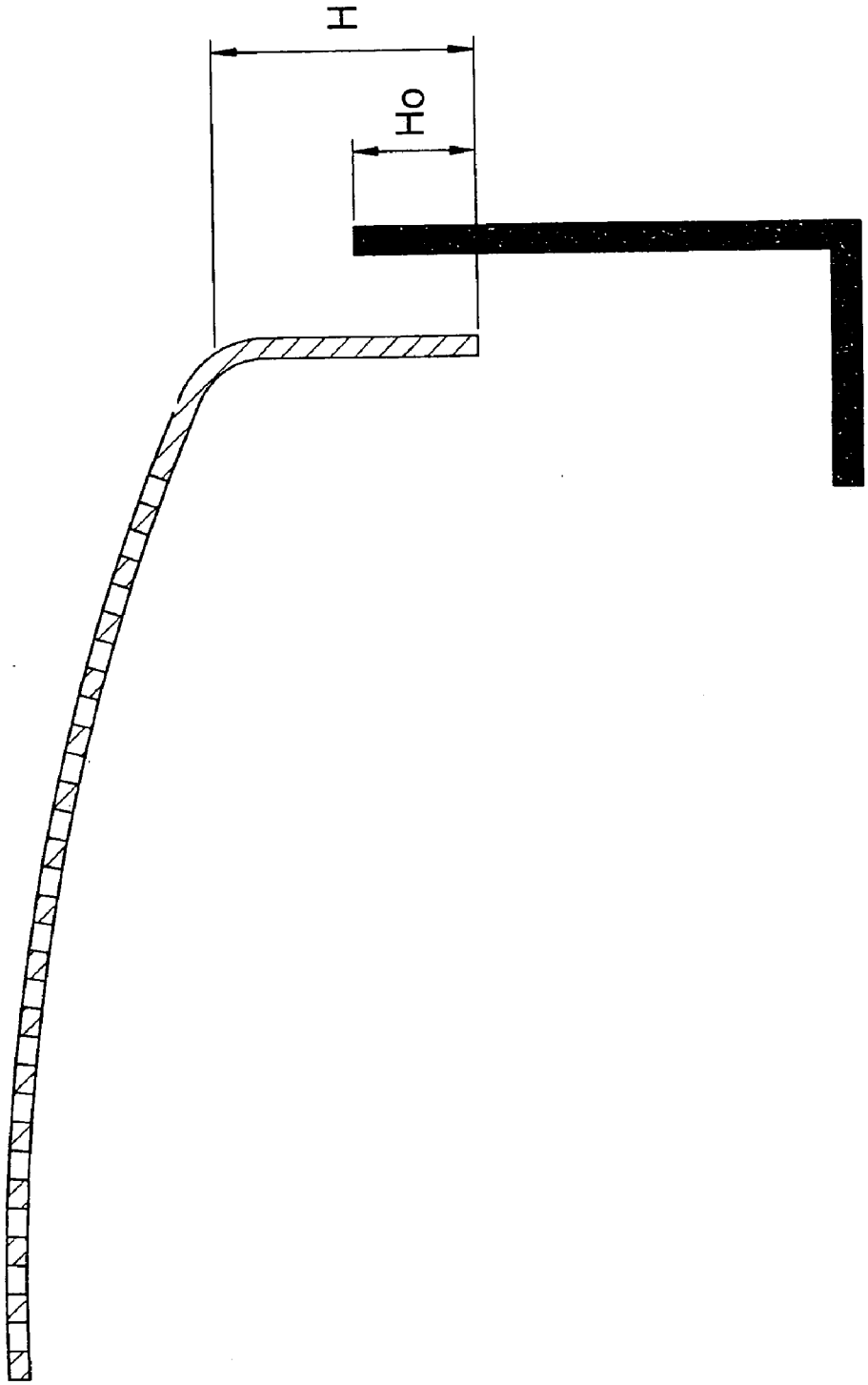
FIG. 11 shows a side view of a shadow mask in accordance with another embodiment of the present invention viewing from the arrow direction of FIG. 5.

FIG. 11 shows a side view of a shadow mask in accordance with a fourth embodiment of the present invention viewing from the arrow direction of FIG. 5.

As shown in FIG. 11, the ratio of a height Ho of the part of the skirt portion which is opposite to the frame and a height H of the skirt portion, i.e., Ho/H, may be less than or equal to 0.8. Heat transfer is thereby reduced. If Ho/H is less than or equal to 0.5, the effect is maximized. Further, holes may be perforated at the skirt portion. Particularly, the holes may be perforated at the part of the skirt portion which is opposite to the frame.

The fourth embodiment may further include such modifications as the use of AK material for the shadow mask; coating an electron beam reflective material on the inner surface of the shadow mask; and making the outer surface of panel to be substantially flat.

As described hereinabove, the present invention achieves a reduction of a landing error of an electron beam, which is caused by non-uniform thermal expansion of a shadow mask.

Further, according to the present invention, AK material may be used instead of invar material. Since AK material is not expensive in comparison with invar material, the overall cost for making a shadow mask is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color cathode ray tube comprising:

a panel having a phosphor screen formed on an inner surface thereof;

a shadow mask having a faceplate portion and a skirt portion bent back from the faceplate portion; and a frame joined to the skirt portion of the shadow mask, wherein a height of the skirt portion is less than or equal to 12 mm for substantially the entire skirt portion and a plurality of holes are perforated at said skirt portion.

2. The color cathode ray tube of claim 1, wherein said holes are perforated at a part of the skirt portion which is opposite to the frame.

3. The color cathode ray tube of claim 1, wherein an edge line of said skirt portion curves toward a front face side of said shadow mask.

4. The color cathode ray tube of claim 3, wherein a length of the edge line of said skirt portion, which is farther from the front face side than the edge line of said frame is less than or equal to ½ of the overall length of the edge line of said skirt portion.

5. The color cathode ray tube of claim 1, wherein said skirt portion includes a protrusion having a welding point at which to weld said frame.

6. The color cathode ray tube of claim 5, wherein a notch is cut at an edge of said protrusion.

7. The color cathode ray tube of claim 5, wherein a hole is perforated at said protrusion.

8. The color cathode ray tube of claim 1, wherein said plurality of holes are opened from a front face side to a rear face side of said skirt portion.

9. The color cathode ray tube of claim 1, wherein said shadow mask is made of aluminum killed material.

10. The color cathode ray tube of claim 1, wherein an electron beam reflective material is coated on a back plate surface of said shadow mask.

11. The color cathode ray tube of claim 1, wherein an outer surface of said panel is substantially flat.

12. The color cathode ray tube of claim 1, wherein at least 65% of the overall skirt portion at a long side of the faceplate portion of said shadow mask is less than or equal to 12 mm.

13. The color cathode ray tube of claim 1, wherein at least 60% of the overall skirt portion at a short side of the faceplate portion of the shadow mask is less than or equal to 12 mm.

14. The color cathode ray tube of claim 1, wherein a ratio of areas of the faceplate portion to the skirt portion of the shadow mask is not less than $d^2/(d+24)^2$ and no greater than 1, wherein d is the diagonal length of the faceplate portion of the shadow mask.

15. The color cathode ray tube of claim 1, wherein a maximum length of a part of said skirt portion which is opposite to said frame is less than or equal to 10 mm.

16. The color cathode ray tube of claim 1, wherein a length of said skirt portion is in a range of 3 mm to 10 mm.

17. The color cathode ray tube of claim 1, wherein said plurality of holes are located at a part of said skirt portion which is not opposite to said frame.

18. The color cathode ray tube of claim 1, wherein a ratio of a height Ho of a part of said skirt portion which is opposite to said frame and a height H of said skirt portion, i.e., Ho/H, is less than or equal to 0.8.

19. The color cathode ray tube of claim 18, wherein the ratio Ho/H is less than or equal to 0.5.

20. A color cathode ray tube comprising:

a panel having a phosphor screen formed on an inner surface thereof;

a shadow mask having a faceplate portion and a skirt portion bent back from the faceplate portion; and a frame joined to the skirt portion, wherein said skirt portion includes a protrusion having a welding point at which to weld said frame, and a ratio of a height Ho of a part of said skirt portion which is opposite to said frame and a height H of said skirt portion, i.e., Ho/H, is less than or equal to 0.8.

21. The color cathode ray tube of claim 20, wherein the ratio Ho/H is less than or equal to 0.5.

22. The color cathode ray tube of claim 20, wherein said shadow mask is made of aluminum killed material.

23. The color cathode ray tube of claim 20, wherein an electron beam reflective material is coated on a back plate surface of said shadow mask.

24. The color cathode ray tube of claim 20, wherein an outer surface of said panel is substantially flat.

25. The color cathode ray tube of claim 20, wherein a plurality of holes are perforated at said skirt portion.

26. The color cathode ray tube of claim 20, wherein a plurality of holes are provided at part of said skirt portion which is opposite to said frame.

* * * * *

UNITED STATES PATENT AND TRADEMARK OFFICE

CERTIFICATE OF CORRECTION

PATENT NO. : 7,105,995 B2
APPLICATION NO. : 10/834011
DATED : September 12, 2006
INVENTOR(S) : Sang Park et al.

It is certified that error appears in the above-identified patent and that said Letters Patent is hereby corrected as shown below:

On the title page, item notice
DELETE: This patent is subject to a terminal disclaimer

Signed and Sealed this

Twenty-sixth Day of June, 2007

JON W. DUDAS
*Director of the United States Patent and Trademark Office*